US009431750B2

(12) United States Patent
Matsunaga

(10) Patent No.: US 9,431,750 B2
(45) Date of Patent: Aug. 30, 2016

(54) CONNECTOR

(71) Applicant: YAZAKI CORPORATION, Tokyo (JP)

(72) Inventor: Takashi Matsunaga, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/680,196

(22) Filed: Apr. 7, 2015

(65) Prior Publication Data

US 2015/0288101 A1 Oct. 8, 2015

(30) Foreign Application Priority Data

Apr. 8, 2014 (JP) ..... 2014-079450

(51) Int. Cl.

| | |
|---|---|
| ***H01R 13/453*** | (2006.01) |
| *H01R 9/03* | (2006.01) |
| *H01R 13/52* | (2006.01) |
| *H01R 13/74* | (2006.01) |

(52) U.S. Cl.

CPC ..... *H01R 13/4538* (2013.01); *H01R 9/03* (2013.01); *H01R 13/5208* (2013.01); *H01R 13/748* (2013.01)

(58) Field of Classification Search

CPC ..... H01R 13/4538; H01R 13/447

See application file for complete search history.

(56) References Cited

U.S. PATENT DOCUMENTS 4,797,116 A * 1/1989 Isohata ..... H01R 13/631 439/141
4,832,613 A * 5/1989 Tsukakoshi ..... H01R 13/631 439/141
5,108,297 A * 4/1992 Hoffman ..... H01R 13/447 439/134
5,348,488 A * 9/1994 Green ..... H01R 12/7005 439/140
5,466,164 A * 11/1995 Miyazaki ..... H01R 13/5213 439/140
5,779,491 A * 7/1998 Nagano ..... H01R 13/629 439/141
5,879,174 A * 3/1999 Kountz ..... H01R 13/6588 439/141
5,961,337 A * 10/1999 Kordes ..... H01R 13/4538 439/141
6,062,881 A * 5/2000 Ellison ..... H01R 13/4538 439/141
6,139,338 A * 10/2000 Hirai ..... G06K 13/0887 439/141
6,821,135 B1 * 11/2004 Martin ..... H01R 13/629 439/141
8,926,344 B2 * 1/2015 Jozwiak ..... B60R 16/0238 439/140
2013/0078872 A1 3/2013 Tashiro

FOREIGN PATENT DOCUMENTS

JP 2012-109035 A 6/2012

* cited by examiner

*Primary Examiner* — Gary Paumen
(74) *Attorney, Agent, or Firm* — Sughrue Mion, PLLC

(57) ABSTRACT

A connector includes a connection terminal including a terminal section which is configured to contact with a mating terminal, a housing that holds the connection terminal in a state that the terminal section protrudes from the housing, and a front holder provided on the housing so as to be slidable along an extension direction of the connection terminal. The front holder is disposed at a first position in which the front holder covers a side portion of the terminal section in a case that the front holder slides forward in the extension direction, and the front holder is disposed at a second position in which the side portion of the terminal section is exposed in a case that the front holder slides rearward in the extension direction.

4 Claims, 7 Drawing Sheets

CONNECTOR

CROSS REFERENCE TO RELATED APPLICATIONS

This application is based on Japanese Patent Application (No. P2014-079450) filed on Apr. 8, 2014, the contents of which are incorporated herein by reference.

BACKGROUND OF THE INVENTION

1. Field of the Invention

The present invention relates to a connector equipped with terminals.

2. Description of the Related Art

As a connector to be mounted on an automobile wire harness or the like, a connector is available in which a plurality of male terminals are held in a housing and the tip ends of these male terminals protrude from the tip end of the housing (refer to JP-A-2012-109035).

In the case of the above-mentioned connector in which the male terminals protrude from the tip end of the housing, a mating connector, foreign matter, etc. may interfere with the portions of the male terminals protruding from the housing, and the male terminals may be deformed or damaged. Hence, when the connector is connected to the mating connector, improper conduction may occur between the male terminals of the connector and the female terminals of the mating connector, and the required electrical performance may not be obtained.

SUMMARY

In consideration of the above-mentioned circumstances, the object of the present invention is to provide a connector capable of preventing the male terminals thereof from being deformed or damaged.

For the purpose of achieving the above-mentioned object, the connector according to the present invention has the following features (1) to (3).

(1) A connector including:

a connection terminal having a terminal section which is configured to contact with a mating terminal;

a housing that holds the connection terminal in a state that the terminal section protrudes from the housing; and a front holder provided on the housing so as to be slidable along an extension direction of the connection terminal, wherein the front holder is disposed at a first position in which the front holder covers a side portion of the terminal section in a case that the front holder slides forward in the extension direction, and the front holder is disposed at a second position in which the side portion of the terminal section is exposed in a case that the front holder slides rearward in the extension direction.

(2) The connector described in the above-mentioned item (1), wherein a guide protrusion is formed on the front holder so as to protrude from a tip end of the front holder which is positioned forward in the extension direction; and wherein the guide protrusion is engaged with a guide concave section formed in a mating housing for holding the mating terminal, thereby a position of the connection terminal is aligned with a position of the mating terminal.

(3) The connector described in the above-mentioned item (2), wherein the guide protrusion is formed so as to protrude from a tip end of the front holder along the extension direction, and the guide protrusion is formed so as to be opposed to a portion of the terminal section positioned further forward in the extension direction than the tip end of the front holder in the case that the front holder is disposed at the first position.

(4) The connector described in the above-mentioned item (1), wherein a front plate section having an insertion hole is formed at a tip end of the front holder; and wherein a tip end of the terminal section is passed through the insertion hole and protrudes from the front plate section forward in the extension direction in the case that the front holder is disposed at the first position.

(5) The connector described in the above-mentioned item (1), wherein an O ring is mounted on the housing; and wherein the O ring restricts a rearward sliding movement of the front holder in the extension direction in the case that the front holder is disposed at the second position.

In the connector configured as described in the above-mentioned item (1), in the case that the front holder slides and is disposed at the first position, the side portion of the terminal section of the connection terminal protruding from the tip end of the housing is covered with the front holder. The front holder is configured so as to protect the terminal section as described above, whereby it is possible to prevent deformation and damage of the terminal section of the connection terminal due to the contact of the terminal section of the connection terminal with the mating connector, foreign matter, etc. Consequently, the occurrence of faulty conduction between the terminal section and the mating terminal can be suppressed. As a result, the desired electrical performance can be obtained between the connectors.

On the other hand, in the connector configured as described in the above-mentioned item (1), the front holder slides and is disposed at the second position when the connector is connected to the mating housing. At this time, the terminal section is not covered with the front holder but is exposed. Hence, the front holder does not prevent the terminal section from making contact with the mating terminal.

In the connector configured as described in the above-mentioned item (2), the guide protrusion of the front holder is engaged with the guide concave section provided in the mating housing. At this time, the position of the connection terminal is aligned with the position of the mating terminal in the state that the guide protrusion is engaged with the guide concave section. Hence, the connection terminal can be connected to the mating terminal securely and smoothly.

In the connector configured as described in the above-mentioned item (3), the portion of the terminal section slightly protruding from the tip end of the front holder can also be protected by the guide protrusion in the case that the front holder is disposed at the first position.

For the purpose of achieving the above-mentioned object, the connector fitting structure according to the present invention has the following feature (6).

(6) A connector fitting structure equipped with the connector described in the above-mentioned item (2) or (3) and the mating housing in which a fitting hole is formed, the connector being fitted in the fitting hole, wherein the guide concave section is formed in a bottom face of the fitting hole in the housing of the mating connector; and wherein the front holder is guided by the fitting hole, thereby the entering direction of the housing of the connector is restricted, and the guide protrusion is engaged with the guide concave section, thereby the position of the connection terminal is aligned with the position of the mating terminal.

In the connector fitting structure configured as described in the above-mentioned item (6), the front holder is guided by the fitting hole, and the guide protrusion of the front holder is engaged with the guide concave section provided in the mating housing. At this time, the front holder is guided by the fitting hole, whereby the entering direction of the housing for supporting the front holder, that is, the fitting direction thereof, is restricted. Furthermore, in the state that the guide protrusion is engaged with the guide concave section, the position of the connection terminal is aligned with the position of the mating terminal in the direction around the axis of the fitting direction. In this way, the attitude of the housing is restricted to its desired attitude. Hence, the housing is fitted into the mating housing while its attitude is maintained, whereby the connection terminal can be connected to the mating terminal securely and smoothly.

With the connector according to the present invention, the male terminals thereof can be prevented from being deformed or damaged.

The present invention has been described above briefly. The details of the present invention will be further clarified by reading the description of the mode (hereafter referred to as "embodiment") for carrying out the invention that is described below referring to the accompanying drawings.

DETAILED DESCRIPTION OF EXEMPLARY EMBODIMENTS

Figure 1:
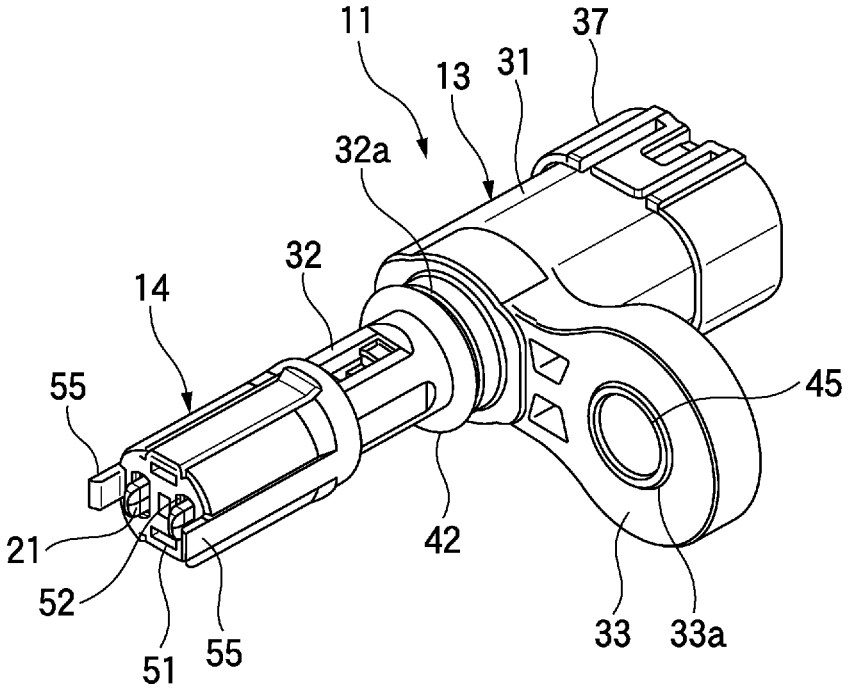
FIG. 1 is a perspective view showing a connector according to this embodiment.

An example of an embodiment according to the present invention will be described below referring to the drawings.

Figure 2:
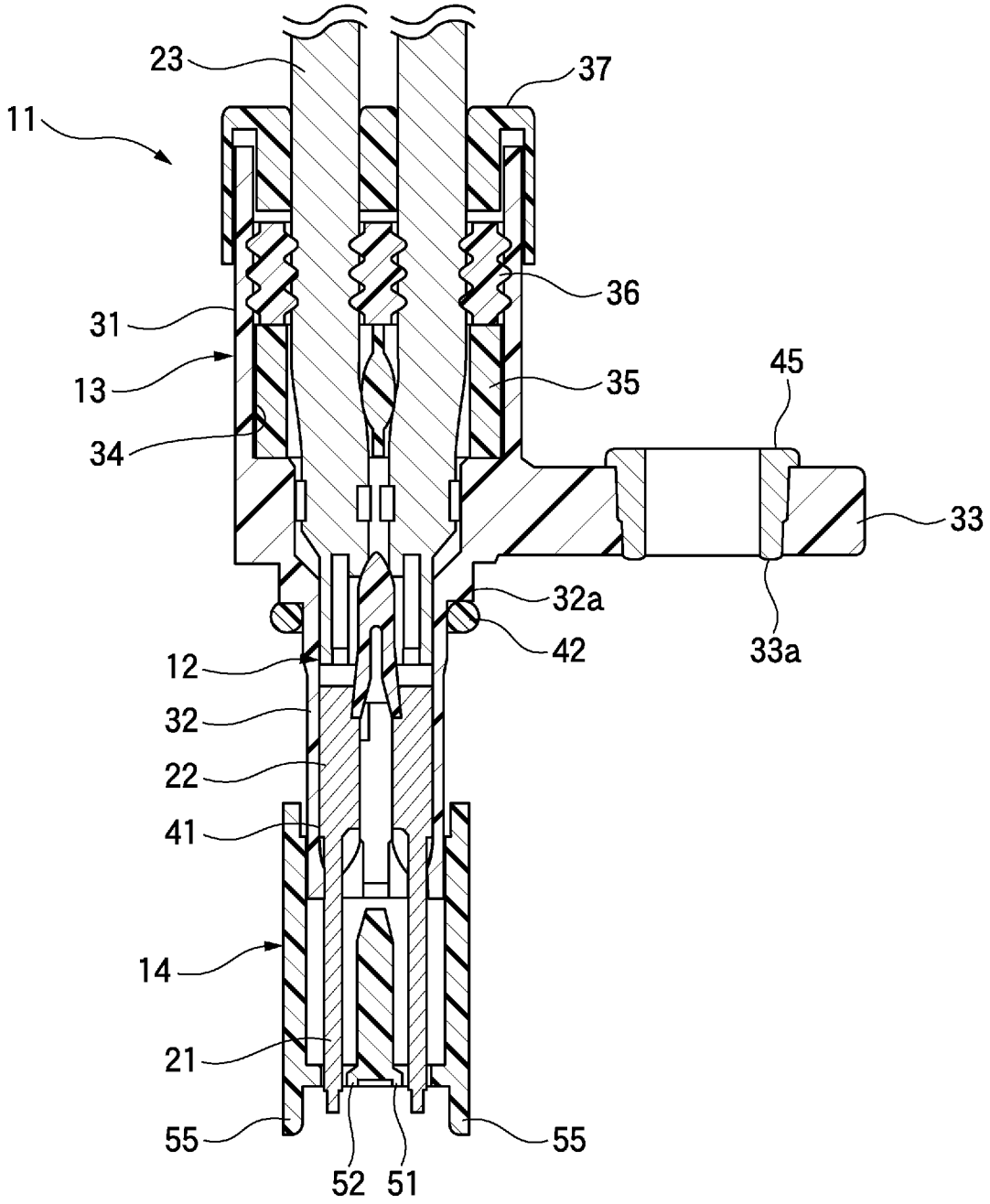
FIG. 2 is a cross-sectional view showing the connector according to this embodiment.
Figure 3:
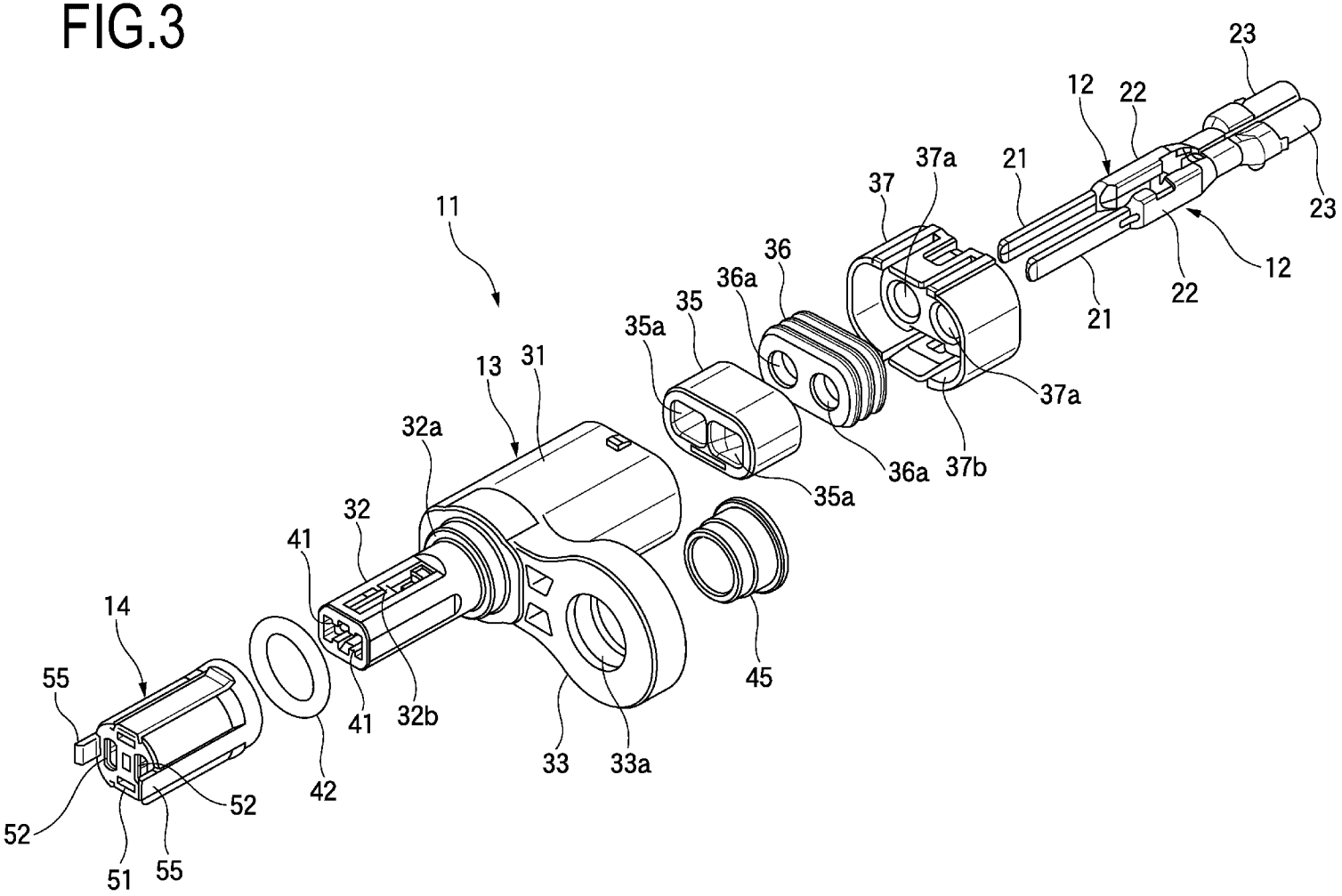
FIG. 3 is an exploded perspective view showing the connector according to this embodiment.

FIG. 1 is a perspective view showing a connector according to this embodiment. FIG. 2 is a cross-sectional view showing the connector according to this embodiment. FIG. 3 is an exploded perspective view showing the connector according to this embodiment.

As shown in FIGS. 1 to 3, a connector 11 according to this embodiment is equipped with a pair of male terminals (connection terminals) 12, a housing 13, and a front holder 14.

The male terminal 12 is made of a conductive metal material, its tip end side is a tab terminal section (sometimes referred to as a terminal section) 21 that is made contact with a mating terminal and conducted and connected thereto, and its rear end side is a crimping section 22 that is connected to the end section of an electric wire 23. The tab terminal section 21 is formed into a rod shape and is inserted into the female terminal (mating terminal) 73 of a mating connector 61 (described later) and conducted and connected thereto. The circumference of the conductor of the electric wire 23 is covered with an outer coat, and the conductor is exposed from the outer coat at its end section. The exposed end section of the conductor of the electric wire 23 is crimped and fixed to the crimping section 22 of the male terminal 12. Hence, the male terminal 12 is connected to the end section of the electric wire 23 in a state that the conductor of the electric wire 23 is conducted to the male terminal 12.

The housing 13 is made of a synthetic resin and has a housing body 31, a fitting section 32, and a fixing section 33.

The housing body 31 has a housing space 34 being open on its rear side. A spacer 35 and a sealing member 36 are housed inside the housing space 34 of the housing body 31 through the opening of the housing body 31, and in this state, a cover 37 is mounted on the opening.

The spacer 35 is made of a synthetic resin and has a pair of electric wire insertion holes 35*a*. The spacer 35 is housed inside the housing space 34 of the housing body 31 from its rear side through the opening. The male terminal 12 is inserted into each of the electric wire insertion holes 35*a* of the spacer 35 from its rear side. The spacer 35 holds the electric wires 23 in a state that the electric wires 23 are respectively disposed in the pair of electric wire insertion holes 35*a*.

The sealing member 36 is made of an elastic material, such as rubber, and has a pair of sealing holes 36*a*. The sealing member 36 is housed inside the housing space 34 of the housing body 31 in which the spacer 35 is housed. The male terminals 12 are inserted into the sealing holes 36*a* of the sealing member 36 from its rear side, and the electric wires 23 are disposed inside the sealing holes 36*a*. Since the sealing member 36 is housed in the housing space 34 of the housing body 31, its outer circumferential surface makes close contact with the inner wall surface forming the housing space 34. In addition, the outer circumferential surfaces of the electric wires 23 inserted into the sealing holes 36*a* of the sealing member 36 make close contact with the inner circumferential surfaces of the sealing holes 36*a*. Hence, the sealing member 36 seals the space between the inner wall surface of the housing space 34 of the housing body 31 and the outer circumferential surfaces of the electric wires 23 and the space between the two electric wires 23. This prevents water and dust from entering the space between the housing body 31 and the electric wires 23 and the space between the two electric wires 23.

The cover 37 is made of a synthetic resin and has a pair of opening sections 37*a*, and the electric wires 23 are inserted into these opening sections 37*a*. The cover 37 has a peripheral wall 37*b* extending forward from its peripheral edge. The cover 37 is mounted so as to cover the rear section of the housing body 31. The cover 37 is mounted so that the peripheral wall 37*b* covers the outer circumferential face of the housing body 31. Hence, the opening portion on the rear side of the housing space 34 of the housing body 31 is closed. The spacer 35 and the sealing member 36 housed in the housing space 34 of the housing body 31 are held in a state of being housed inside the housing space 34 by mounting the cover 37 on the housing body 31.

The fitting section 32 is integrally formed on the front side of the housing body 31 and protrudes forward from the housing body 31. In the fitting section 32, a pair of terminal holding spaces 41 communicating with the housing space 34 of the housing body 31 is formed. The respective terminal holding spaces 41 are open at the tip end of the fitting section 32. The male terminals 12 are inserted into the terminal holding spaces 41 from the side of the housing body 31. Each of the male terminals 12 inserted into the terminal holding spaces 41 is held so that the tab terminal section 21 on the tip end side thereof protrudes from the tip end of the fitting section 32 and so that the crimping section 22 thereof is positioned inside the terminal holding space 41. The pair of male terminals 12 is held at positions opposed to each other.

In each of the terminal holding spaces 41, a lance (not shown) engaging with the male terminal 12 and restricting the rearward movement of the male terminal 12 is provided. A ring-shaped O-ring 42 is mounted on the outer circumference of the fitting section 32. This O-ring 42 is fitted from the tip end side of the fitting section 32 and is mounted in a state of being made contact with the step section 32*a* formed at the fitting section 32 on the side of the housing body 31. A locking protrusion 32*b* for positioning the front holder 14 sliding with respect to the fitting section 32 at a protection position (described later) is formed on the outer circumference of the fitting section 32.

The fixing section 33 is integrally formed on the housing body 31 and extends sideward from the housing body 31. A bolt insertion hole 33*a* is formed in the fixing section 33. A cylindrical collar 45 is fitted into this bolt insertion hole 33*a* from the rear side of the fixing section 33. A fixing bolt 65 (described later) is inserted from the rear side into the bolt insertion hole 33*a* of the fixing section 33 in which the collar 45 is fitted.

The front holder 14 is made of a synthetic resin and formed into a cylindrical shape. A front plate section 51 is formed at the tip end section of the front holder 14. A pair of tab insertion holes 52 is formed in this front plate section 51. The tab terminal sections 21 of the male terminals 12 can be inserted into the tab insertion holes 52. The front holder 14 is mounted on the fitting section 32 of the housing 13 so as to be fitted from the tip end side thereof and is provided so as to be slidable along the extension direction of the male terminals 12. Since the fitting section 32 of the housing 13 is extended along the extension direction of the male terminals 12, the front holder 14 in which the fitting section 32 is fitted can slide along the extension direction.

When the front holder 14 slides forward in the extension direction with respect to the fitting section 32 of the housing 13, the front holder 14 is disposed at the protection position (referred to as a first position) in which the tab terminal sections 21 of the male terminals 12 protruding from the tip end of the fitting section 32 are covered almost entirely. Since the locking protrusion formed inside the cylindrical front holder 14 is temporarily locked with the locking protrusion 32*b* of the fitting section 32, the front holder 14 can be retained at the protection position. In the state that the front holder 14 is disposed at the protection position, the portion of the tip end side of the tab terminal section 21 of each male terminal 12 slightly protrudes from the front plate section 51 of the front holder 14 (see FIG. 2). The portion of the tab terminal section 21 slightly protrudes from the front plate section 51 so that the tab terminal section 21 is guided by the tab insertion hole 52 when the front holder 14 slides rearward in the extension direction. Hence, the rearward sliding of the front holder 14 in the extension direction can be performed smoothly.

On the other hand, when the front holder 14 slides rearward in the extension direction with respect to the fitting section 32 of the housing 13, a rear end section of the front holder 14 makes contact with the O-ring 42 mounted on the fitting section 32, whereby the front holder 14 is disposed at a connectable position (a second position) in which the further rearward sliding thereof is restricted. When the front holder 14 is disposed at the connectable position, the whole tab terminal sections 21 of the male terminals 12 protrude from the front plate section 51 of the front holder 14. At this time, the side portions of the tab terminal sections 21 are not covered with the front holder 14 but are exposed. Hence, when the front holder 14 is disposed at the connectable position, the connector 11 can be connected to the mating connector 61.

In addition, guide protrusions 55 protruding along the extension direction of the male terminals 12 from the front plate section 51 positioned at the tip end of the front holder 14 are formed on the front holder 14. The guide protrusions 55, two in number, are formed so as to be opposed to each other. The guide protrusions 55 protrude in the same direction as the extension direction of the male terminals 12. The guide protrusions 55 are formed at the positions opposed to the portions of the tab terminal sections 21 that are positioned further forward in the extension direction than the front plate section 51 of the front holder 14 in the case that the front holder 14 is disposed at the protection position. Hence, the two tab terminal sections 21 and the two guide protrusions 55 are disposed so as to be arranged in a row as shown in FIGS. 1 and 2. In the case that the front holder 14 is disposed at the protection position, the portions of the tab terminal sections 21 slightly protruding from the front plate section 51 of the front holder 14 can also be protected by the guide protrusions 55.

Figure 4:
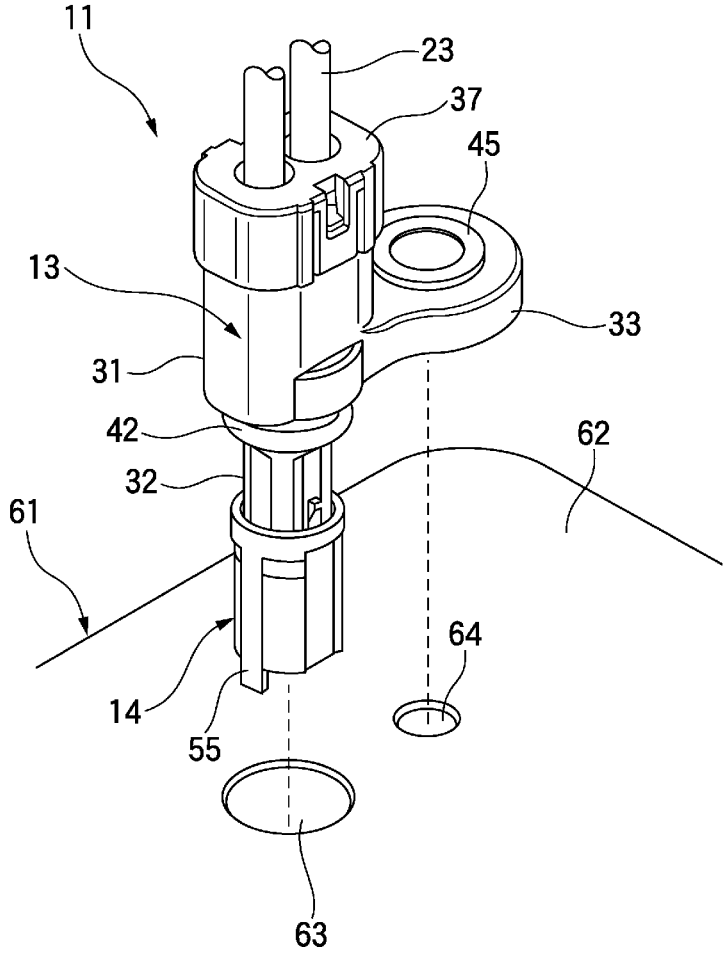
FIG. 4 is a perspective view showing the housing portions of the connector and a mating connector.
Figure 5:
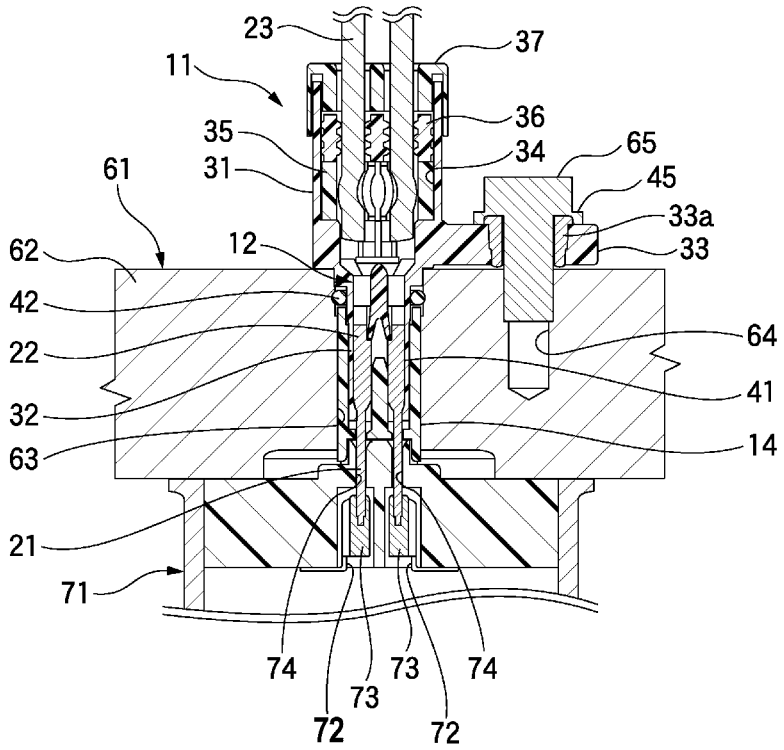
FIG. 5 is a cross-sectional view showing a state that the connector is connected to the mating connector.
Figure 6:
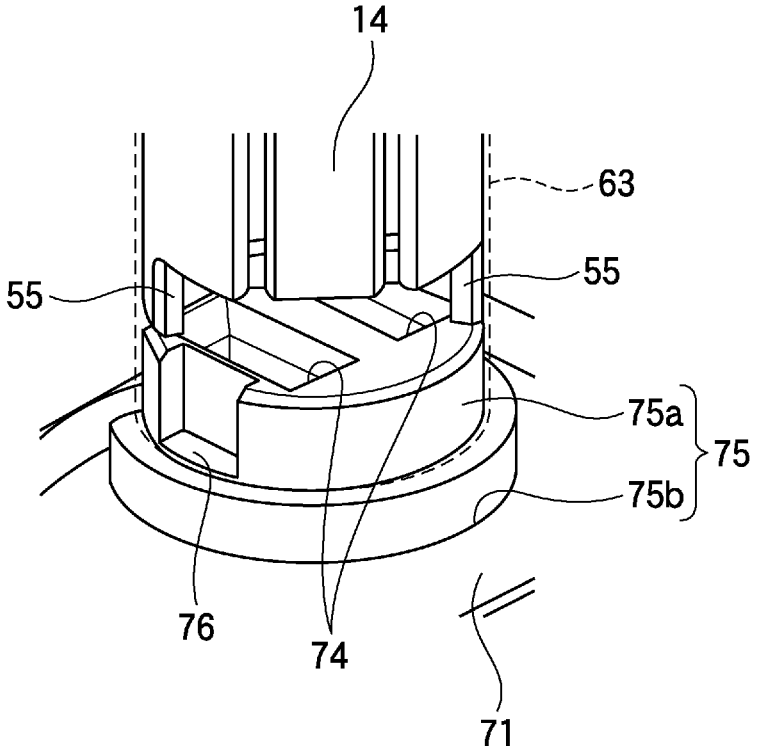
FIG. 6 is a perspective view showing the front holder and a housing-side terminal holder viewed through the housing.

FIG. 4 is a perspective view showing the housing portions of the connector and the mating connector. FIG. 5 is a cross-sectional view showing a state that the connector is connected to the mating connector. FIG. 6 is a perspective view showing the front holder and a housing-side terminal holder viewed through the housing.

As shown in FIGS. 4 to 6, the mating connector 61 to which the connector 11 according to this embodiment is connected is formed on, for example, an electronic apparatus. In this embodiment, a mode is described in which the mating connector 61 is composed of the housing 62 of an electronic apparatus and a housing-side terminal holder 71 positioned inside the housing 62. The housing 62 and the housing-side terminal holder 71 are sometimes collectively referred to as a mating housing. However, the connector according to the present invention is not limited by the configuration of the mating connector 61 that is described below.

A fitting hole 63 is drilled in the housing 62. The fitting section 32 having the front holder 14 of the connector 11 is fitted in this fitting hole 63. In addition, in the housing 62, a screw hole 64 is formed near the fitting hole 63. The fixing bolt 65 inserted into the bolt insertion hole 33*a* of the fixing section 33 of the connector 11 is screwed into this screw hole 64.

Furthermore, the housing-side terminal holder 71 is provided inside the housing 62 that is positioned on the side opposite to the side to which the connector 11 is connected. On the housing-side terminal holder 71, a pair of cavities 72 is formed, and in these cavities 72, the female terminals 73 are housed and held. The female terminals 73 are made of a conductive metal material and connected to, for example, electronic components mounted on the electronic apparatus via wiring. On the housing-side terminal holder 71, a receiving base 75 rising on the side of the housing 62 is formed. The receiving base 75 has a shape in which a disc-shaped small diameter base 75*a* having an outside diameter nearly equal to the outside diameter of the front holder 14 and a disc-shaped large diameter base 75*b* having an outside diameter larger than that of the small-diameter base 75*a* are stacked while their axial centers are aligned with each other. In the small-diameter base 75*a* and the large-diameter base 75*b*, a pair of tab insertion holes 74 into which the tab terminal sections 21 of the male terminals 12 of the connector 11 can be inserted is formed so as to communicate with the cavities 72. The female terminals 73 are made contact with the male terminals 12 and conducted and connected thereto when the tab terminal sections 21 of the male terminals 12 are inserted into the tab insertion holes 74 and enter the cavities 72.

In the small-diameter base 75*a* of the receiving base 75, guide concave sections 76 recessed toward the inside in the radial direction are formed as shown in FIG. 6. The dimension of the guide concave section 76 is slightly larger than the outside dimension of the guide protrusion 55. The guide concave sections 76 are formed in two places in the small-diameter base 75*a* at positions corresponding to the two guide protrusions 55. Hence, when the fitting section 32 having the front holder 14 of the connector 11 is inserted into the fitting hole 63, the guide protrusions 55 of the front holder 14 enter the guide concave sections 76 by rotating the connector 11 around its axial center, whereby the guide protrusions 55 can be engaged with the guide concave sections 76. The female terminals 73 and the tab insertion holes 74 are provided in the housing-side terminal holder 71 so as to be located at normal positions in which the tab terminal sections 21 of the male terminals 12 can enter the female terminals 73 when the guide protrusions 55 and the guide concave sections 76 are located at positions where they are engaged with each other.

Next, a case in which the connector 11 according to this embodiment is connected to the mating connector 61 will be described.

Figure 7A:
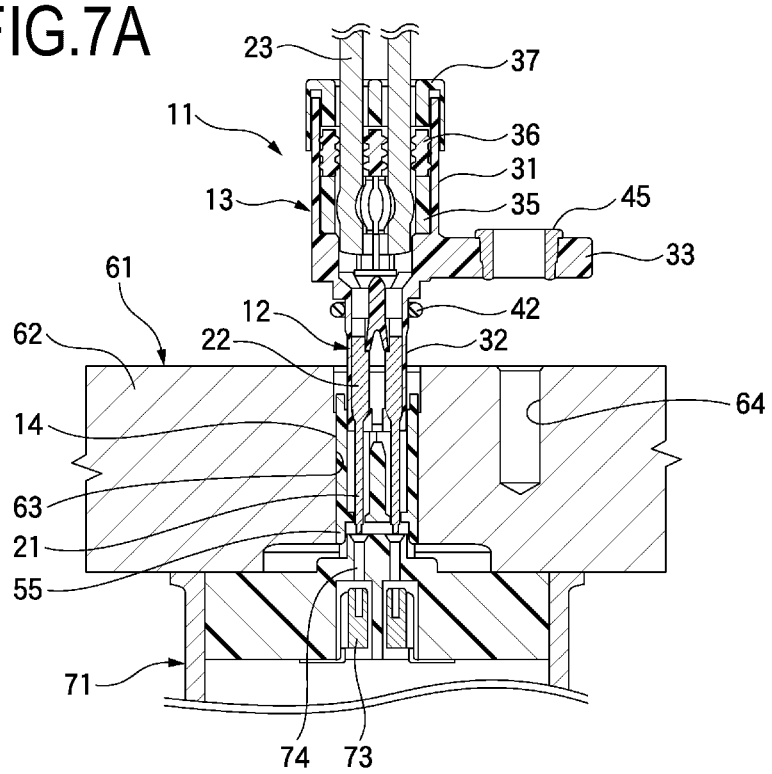
FIGS. 7A and 7B are views showing states in which the connector is being connected to the mating connector, and are respectively cross-sectional views showing the connector and the mating connector.
Figure 7B:
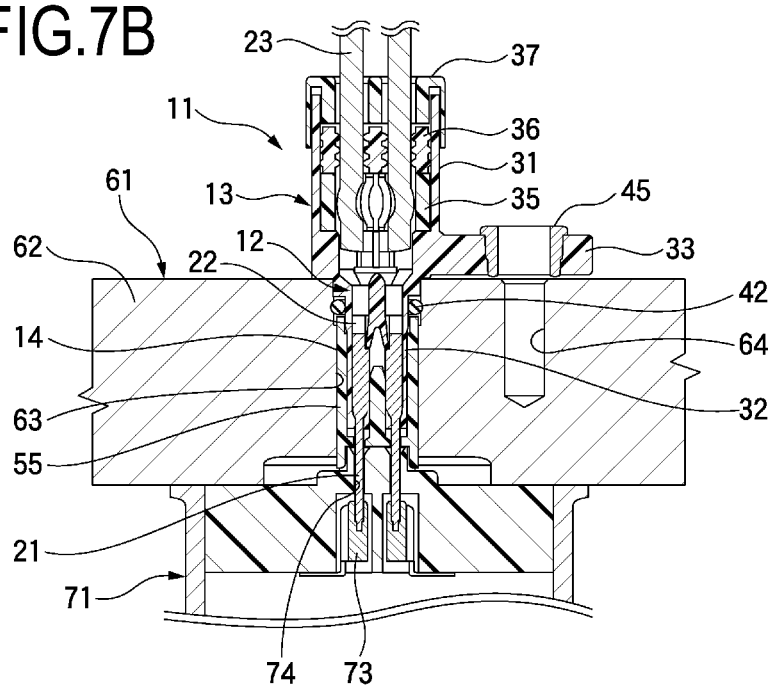

FIGS. 7A and 7B are views showing states in which the connector is being connected to the mating connector, and are respectively cross-sectional views showing the connector and the mating connector.

In a state that the fixing section 33 of the housing 13 of the connector 11 is disposed on the side of the screw hole 64, the front holder 14 at the tip end of the connector 11 is inserted into the fitting hole 63 of the mating connector 61. At this time, the major portions of the tab terminal sections 21 of the male terminals 12 are covered with the front holder 14 that is disposed at the protection position, and the guide protrusions 55 of the front holder 14 are disposed on the sides of the portions of the tab terminal sections 21 slightly protruding from the front plate section 51 of the front holder 14. Hence, a problem such that the tab terminal sections 21 are made contact with, for example, the housing 62 of the mating connector 61, and are deformed and damaged is prevented.

The fitting section 32 of the connector 11 is then further inserted into the fitting hole 63 of the mating connector 61. At this time, the front holder 14 is guided by the fitting hole 63, whereby the entering direction of the housing 13 for supporting the front holder 14, that is, the fitting direction thereof, is restricted. With this configuration, in the case that the positions of the guide protrusions 55 are deviated from the positions of the guide concave sections 76 as shown in FIG. 7A, the tip ends of the guide protrusions 55 of the front holder 14 make contact with the upper face of the small-diameter base 75*a* of the housing-side terminal holder 71 (see FIG. 6). At this time, the guide protrusions 55 can be entered into the guide concave sections 76 by rotating the connector 11 around the axial center of the housing 13 and by aligning the positions of the guide protrusions 55 with the positions of the guide concave sections 76. The positions of the guide protrusions 55 can be easily aligned with the positions of the guide concave sections 76 by rotating the connector 11 so that the bolt insertion hole 33*a* of the fixing section 33 is aligned with the screw hole 64 of the housing 62. As described above, in the state that the guide protrusions 55 are engaged with the guide concave sections 76, the further movement of the front holder 14 in the insertion direction of the connector 11 is restricted, and the male terminals 12 and the female terminals 73 are positioned in the circumferential direction around the axis of the fitting direction of the housing 13.

From this state, the connector 11 is further inserted into the mating connector 61. The front holder 14, the movement of which is restricted along the insertion direction of the connector 11, then slides relatively rearward with respect to the housing 13 as shown in FIG. 7B, and at the same time, the tab terminal sections 21 of the male terminals 12 enter forward relatively from the tab insertion holes 52 of the front plate section 51 of the front holder 14. At this time, since the positions of the tab terminal sections 21 of the male terminals 12 are aligned with the positions tab insertion holes 74 of the housing-side terminal holder 71, the tab terminal sections 21 are inserted into the tab insertion holes 74 of the housing-side terminal holder 71 and inserted into the female terminals 73, thereby being made contact with the female terminals 73 and conducted and connected thereto. In this state, the fitting of the fitting section 32 of the housing body 31 into the fitting hole 63 of the housing 62 is completed. At this time, the O-ring 42 of the fitting section 32 is disposed inside the fitting hole 63, and the space between the outer circumferential surface of the fitting section 32 and the inner circumferential surface of the fitting hole 63 is sealed with the O-ring 42.

Next, the fixing bolt 65 is inserted into the bolt insertion hole 33*a* of the fixing section 33 of the connector 11 and screwed into the screw hole 64 of the housing 62. The connector 11 is thus fastened and fixed to the housing 62 in the state of being connected to the mating connector 61, and the male terminals 12 are maintained in the state of being conducted and connected to the female terminals 73 (see FIG. 5).

As described above, in the connector 11 according to this embodiment, the front holder 14 is disposed at the protection position in which the side portions of the tab terminal sections 21 are covered in the case that the front holder 14 slides forward in the extension direction of the male terminals 12, and the front holder 14 is disposed at the connectable position in which the side portions of the tab terminal sections 21 are exposed in the case that the front holder 14 slides rearward in the extension direction.

Hence, the tab terminal sections 21 of the male terminals 12 protruding from the tip end of the fitting section 32 of the housing 13 are covered with the front holder 14, whereby it is possible to prevent deformation and damage of the tab terminal sections 21 of the male terminals 12 due to the contact of the tab terminal sections 21 of the male terminals 12 with the mating connector 61, foreign matter, etc. Consequently, faulty conduction at the time of the connection to the mating connector 61 can be suppressed. As a result, the desired electrical performance can be obtained between the connectors. Furthermore, since the front holder 14 slides rearward and the tab terminal sections 21 are exposed at the time of connection to the mating connector 61, the front holder 14 does not become an obstacle at the time of the connection to the mating connector 61.

Moreover, the guide protrusions 55 protruding from the tip end of the front holder 14 positioned forward in the extension direction of the male terminals 12 are formed in the front holder 14, and the connector 11 is connected to the mating connector 61 so that the guide protrusions 55 are engaged with the guide concave sections 76 formed in the housing-side terminal holder 71. At this time, the front holder 14 is guided by the fitting hole 63, whereby the entering direction of the housing 13 for supporting the front holder 14, that is, the fitting direction thereof, is restricted. Still further, in the state that the guide protrusions 55 are engaged with the guide concave sections 76, the male terminals 12 and the female terminals 73 are positioned in the circumferential direction around the axis of the fitting direction. In this way, the attitude of the housing 13 is restricted to its desired attitude. Hence, the housing 13 is fitted into the mating housing while its attitude is maintained, whereby the male terminals 12 can be connected to the female terminals 73 securely and smoothly.

In addition, the guide protrusions 55 are formed so as to be opposed to the portions of the tab terminal sections 21 positioned further forward in the extension direction of the male terminals 12 than the tip end of the front holder 14 in the case that the front holder 14 is disposed at the protection position. The guide protrusions 55 can also protect the portions of the tab terminal sections 21 slightly protruding from the front plate section 51 of the front holder 14 in the case that the front holder 14 is disposed at the protection position.

Although the case in which the male terminals 12 are provided on the connector 11 and the male terminals 12 of the connector 11 are conducted and connected to the female terminals 73 of the mating connector 61 is taken as an example and described in the above-mentioned embodiment, it may be possible to use a configuration in which female terminals are provided as connection terminals on the side of the connector 11 and the female terminals of the connector 11 are conducted and connected to the male terminals of the mating connector 61. In this case, the front holder 14 is disposed at a protection position in which the terminal sections of the tip end portions of the female terminals protruding from the fitting section 32 are covered, and the front holder 14 is slid rearward and disposed at a connectable position in which the terminal sections of the female terminals are exposed at the time of the connection to the mating connector 61.

However, the present invention is not limited to the above-mentioned embodiment, but can be modified or improved as necessary. In addition, the materials, shapes, dimensions, numbers, arrangement positions, etc. of the respective components in the above-mentioned embodiment may be arbitrary and not limited, provided that the present invention can be achieved.

What is claimed is:

1. A connector comprising:

a connection terminal including a terminal section which is configured to contact with a mating terminal;

a housing that holds the connection terminal in a state that the terminal section protrudes from an end portion of the housing; and a front holder provided on the housing so as to be slidable along an extension direction of the connection terminal, the front holder comprising a guide protrusion formed on the front holder so as to protrude from a tip end of the front holder, wherein the front holder is disposed at a first position in which the front holder covers a side portion of the terminal section when the front holder slides forward in the extension direction, and the front holder is disposed at a second position in which the side portion of the terminal section is exposed when the front holder slides rearward in the extension direction, wherein the guide protrusion is configured to engage a recessed guide section formed in a mating housing for holding the mating terminal to thereby align a position of the connection terminal with a position of the mating terminal.

2. The connector according to claim 1, wherein the guide protrusion is formed so as to protrude from a tip end of the front holder along the extension direction; and wherein the guide protrusion is formed so as to be opposed to a portion of the terminal section positioned further forward in the extension direction than the tip end of the front holder in the case that the front holder is disposed at the first position.

3. The connector according to claim 1, wherein a front plate section having an insertion hole is formed at a tip end of the front holder; and wherein a tip end of the terminal section is passed through the insertion hole and protrudes from the front plate section forward in the extension direction in the case that the front holder is disposed at the first position.

4. The connector according to claim 1, wherein an O ring is mounted on the housing; and wherein the O ring restricts a rearward sliding movement of the front holder in the extension direction in the case that the front holder is disposed at the second position.

* * * * *